US005896624A

United States Patent [19]

Horswell

[11] Patent Number: 5,896,624

[45] Date of Patent: Apr. 27, 1999

[54] BINDER CLIP

[76] Inventor: Stephen Lee Horswell, 727 Nautilus, Crosby, Tex. 77532

[21] Appl. No.: 09/066,642

[22] Filed: Apr. 24, 1998

[51] Int. Cl.[6] ..... B42F 1/00; A44B 21/00

[52] U.S. Cl. ..... 24/67.5; 24/67 R; 24/67.9; 24/545

[58] Field of Search ..... 24/67.5, 67 R, 24/67.9, 545, 563

[56] References Cited

U.S. PATENT DOCUMENTS

| | | | |
|---|---|---|---|
| 430,169 | 6/1890 | Brown | 24/67.5 |
| 475,259 | 5/1892 | Turck | 24/67.5 |
| 1,139,627 | 5/1915 | Baltzley . | |
| 1,865,453 | 7/1932 | Baltzley | 24/545 |
| 2,259,505 | 10/1941 | Wisdom | 24/67.5 |
| 3,286,381 | 11/1966 | Wooge . | |
| 4,332,060 | 6/1982 | Sato . | |
| 4,532,680 | 8/1985 | Hashimoto . | |
| 5,533,236 | 7/1996 | Tseng . | |
| 5,806,147 | 9/1998 | Sato | 24/67.5 |

*Primary Examiner*—Victor N. Sakran

[57] ABSTRACT

An improved binder clip comprised of resilient sheet metal pincher substantially triangular in cross section and metallic wire actuating arms which are rotably hinged at pincher grip edges. Pressure applied on the actuating arms urge open the pincher at grip edges while making contact at pivot bars. By providing a pivot point closer to the gripping edges, the pincher requires less pressure to open and consequently less pain and discomfort to the fingertips.

8 Claims, 1 Drawing Sheet

BINDER CLIP

BACKGROUND OF THE INVENTION

The present invention relates to a clip used for binding papers together.

In the typical design of prior art for a clip used in binding papers together, a sheet metal pincher bent into triangular cross section is opened by pressing on metallic wire actuating arms (2) hinged at the two gripping edges. These actuating arms rest on upper and lower surface of pincher and must by design extend a considerable distance past the back edge of the pincher. After pincher is opened and then relaxed to grip papers, actuating arms may be left in the opening position (up position) or pivoted down at hinges to lay flat against the papers. In either position these arms interfere with viewing and turning the pages. The other major problem is the difficulty in opening this type of clip. A great deal of pressure must be exerted on the actuating arms to force open the pincher. This causes pain and discomfort in the fingertips, especially with the larger clips.

BRIEF SUMMARY OF THE INVENTION

It is the primary objective of the present invention to provide a binder clip which is significantly easier to open and therefore significantly reduces the amount of pain and discomfort in the fingertips when applying pressure to the actuating arms. Because of the greater efficiency in opening (as will become clear), it now is possible to reduce the length of the actuating arms. Reduction in the length of the actuating arms will reduce the interference to viewing and turning pages caused by said actuating arms in either position.

A further objective of this invention is to provide an economical clip to manufacture.

DETAILED DESCRIPTION OF THE INVENTION

Figure 1:
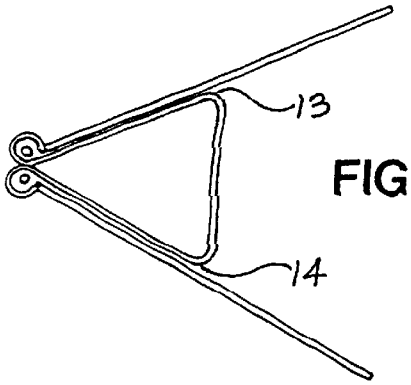
FIG 1 (PRIOR ART)
FIG. 1 is a side view of the prior art.
Figure 2:
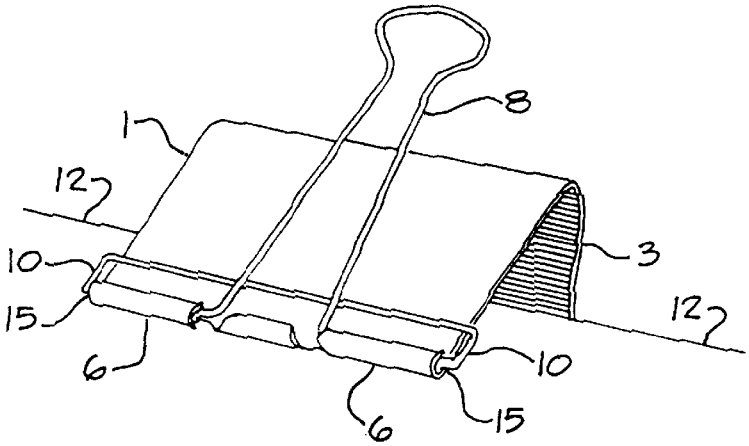
FIG. 2 is a perspective view of the present invention.
Figure 3:
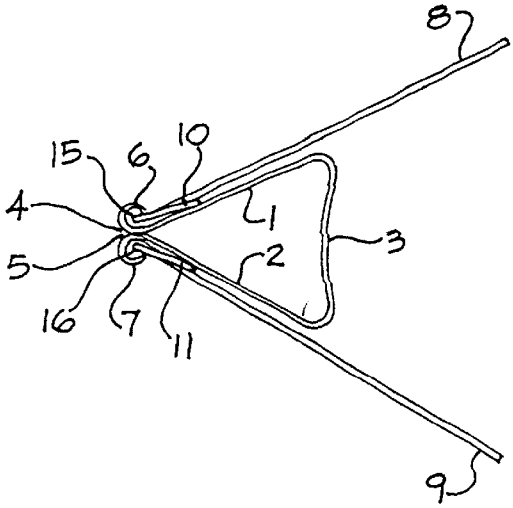
FIG. 3 is a side view of the present invention.

The present invention is shown in FIG. 2 and FIG. 3 as a resilient sheet metal pincher with upper surface 1, lower surface 2 and connecting surface 3. The side view FIG. 3 shows the pincher to be substantially triangular in cross section. Upper surface 1 and lower surface 2 contact each other at upper gripping edge 4 and lower gripping edge 5. Substantially tubular hinge hooks at upper surface 6 and lower surface 7 rotatably retain metallic wire actuating arms 8, 9. Pincher is opened by applying pressure at 8 and 9. FIG. 1 shows a side view of the prior art. In the case of prior art the actuating arms pivot at points 13 and 14. According to FIG. 3 the present invention uses an upper pivot bar 10 and a lower pivot bar 11 for actuating arms 8 and 9 to pivot from. This places the pivot point closer to the load. Pivot bars 10 and 11 are metallic wire bent into a substantially "U" shaped configuration with ends of "U" bent inward to form legs which fit into outside ends of hinge hooks 15, 16. Pressure at actuating arms 8 and 9 is released to close the pincher and firmly grip papers or the like 12.

What is claimed is:

1. An improved binder clip comprising:

sheet metal pincher of substantially triangular cross sectional shape with upper and lower surface and connecting surface, said pincher being resiliently biased such that upper and lower surfaces contact each other at pincher gripping edges; substantially tubular hinge hooks at said gripping edges of upper and lower surface; bent metallic wire actuating arm at respective upper and lower surface of pincher with each end of actuating arm being rotatably retained by hinge hook; pivotal means contacting upper and lower surface of pincher respectively and providing an efficient fulcrum for actuating arm; said pincher being urged open at hinge hooks by applying pressure at both actuating arms, whereby the pincher can be opened easily without any loss of gripping force.

2. The binder clip according to claim 1, wherein the pivotal means is provided by crimping the actuating arms.

3. The binder clip according to claim 1, wherein the pivotal means is provided by crimping the upper and lower surface of pincher.

4. The binder clip according to claim 1, wherein the pivotal means is provided by a metallic wire pivot bar.

5. The binder clip according to claim 4, further including resilient retainage of pivot bar ends at ends of hinge hooks.

6. The binder clip according to claim 4, further including direct bonding of pivot bar to binder clip.

7. The binder clip according to claim 4, further including mechanical attachment of pivot bar to binder clip.

8. The binder clip according to claim 4, further including frictional attachment of pivot bar to binder clip.

* * * * *